United States Patent [19]

Suzuki et al.

[11] Patent Number: 4,814,670

[45] Date of Patent: Mar. 21, 1989

[54] CATHODE RAY TUBE APPARATUS HAVING FOCUSING GRIDS WITH HORIZONTALLY AND VERTICALLY OBLONG THROUGH HOLES

[75] Inventors: Hiroshi Suzuki, Nagaokakyo; Masao Natsuhara, Otsu; Chisato Kurusu, Suita, all of Japan

[73] Assignee: Matsushita Electronics Corporation, Kadoma, Japan

[21] Appl. No.: 788,484

[22] Filed: Oct. 17, 1985

[30] Foreign Application Priority Data

Oct. 18, 1984 [JP] Japan ..... 59-220004

[51] Int. Cl.[4] ..... H01J 29/46

[52] U.S. Cl. ..... 315/15; 313/414; 315/382

[58] Field of Search ..... 315/14, 15, 16, 382, 315/370, 371; 313/453, 414

[56] References Cited

U.S. PATENT DOCUMENTS

| | | | |
|---|---|---|---|
| 3,066,235 | 11/1962 | McNaney | 313/453 |
| 3,849,696 | 11/1974 | Peter et al. | 315/14 |
| 3,863,097 | 1/1975 | Labudda | 315/14 |
| 3,881,136 | 4/1975 | Scheele | 313/453 |
| 3,952,224 | 4/1976 | Evans, Jr. | 313/453 |
| 4,277,722 | 7/1981 | Hawken et al. | 315/16 |
| 4,473,775 | 9/1984 | Hosokoshi et al. | 315/14 |
| 4,583,024 | 4/1986 | Chen | 313/414 |
| 4,614,894 | 9/1986 | Izumida | 313/414 |
| 4,622,491 | 11/1986 | Izumida et al. | 313/414 |
| 4,626,738 | 12/1986 | Gerlach | 313/414 |
| 4,725,332 | 6/1981 | Ashizaki et al. | 313/414 |
| 4,728,859 | 3/1988 | Natsuhara | 315/15 |

FOREIGN PATENT DOCUMENTS

| | | | |
|---|---|---|---|
| 57-151153 | 9/1982 | Japan | 313/414 |

*Primary Examiner*—Theodore M. Blum
*Assistant Examiner*—David Cain
*Attorney, Agent, or Firm*—Cushman, Darby & Cushman

[57] ABSTRACT

The present invention relates to a cathode ray tube apparatus which can reduce an astigmatism caused from the deflection distortion by providing its focusing grid in two parts and producing a dynamic focusing lens of a quadrupole between the opposing faces of the two focusing grid parts. One focusing grid preferably has vertically disposed oblong through holes, while the other focusing grid preferably has one or more horizontally disposed oblong through holes.

3 Claims, 4 Drawing Sheets

CATHODE RAY TUBE APPARATUS HAVING FOCUSING GRIDS WITH HORIZONTALLY AND VERTICALLY OBLONG THROUGH HOLES

FIELD OF THE INVENTION AND RELATED ART STATEMENT

1. Field of the Invention

The present invention relates to a cathode ray tube apparatus which can attain a high resolution over the entire phosphor screen.

2. Description of the Related Art

The resolution characteristic of a cathode ray tube depends greatly on the size and shape of a beam spot. That is, a high resolution can be obtained only when the beam spot, namely, the luminous spot produced on the phosphor screen by impingement of an electron beam, has a narrow diameter and is nearly round.

Although a beam spot with a narrow diameter and round shape is obtained in the center of the phosphor screen at the just focusing voltage, the spot becomes over-focused due to deflection, thereby causing a spot size increase with a distortion of the spot shape. Resolution is thus deteriorated in the peripheral part of the screen. The reason for this is that an electron beam path from the electron gun to the phosphor screen becomes longer as the deflection is increased.

Generally, a dynamic focusing method is used in which the focus voltage is increased in proportion to the deflection to decrease the main lens action so that the over-focusing is compensated for. However, the dynamic focusing method is not used effectively for an in-line type color cathode ray tube for the reason as mentioned below.

The in-line type color cathode ray tube has three cathodes for emitting electron beams disposed on a horizontal plane. The horizontally arranged electron beams can be converged onto one point on the whole screen automatically with the use of a self-convergence deflection yoke. The magnetic field distribution of the self-convergence deflection yoke is intentionally distorted in a pincushion type for the horizontal and in a barrel type for the vertical deflection field. Concomitantly and undesirably, the distortion of the magnetic field distribution causes a distortion on a sectional shape of an electron beam passing through the magnetic field. Consequently, the beam spot produced on the screen is also distorted to a non-circular shape, which is more obvious in the peripheral region. The phosphor screen is usually a rectangular shape which is longer in the horizontal direction. Due to the horizontally longer dimension of the phosphor screen, a stronger distortion occurs in both lateral side parts of the screen.

Three electron beams 1, 2 and 3 travelling from the back side of the paper of FIG. 1, are subject to a deflection force in a direction indicated by arrows 5 by a function of the horizontal deflection magnetic field 4 which is distorted in a pincushion shape. The horizontal deflection magnetic field 4 of the pincushion distribution is constituted from a dipole magnetic field component 6 shown in FIG. 2(*a*) and a quadrupole magnetic field component 7 shown in FIG. 2(*b*). The dipole component 6 gives the beam 9 a deflection force in a direction indicated by an arrow 8. It is the dipole component of the horizontal field 4 in FIG. 1 that gives the beams 1, 2 and 3 the deflection force in the direction indicated by arrows 5. The quadrupole magnetic field component 7 gives the beams 1, 2 and 3 a self-converging action so that the three electron beams are automatically converged onto one point on the whole area of the screen. In addition, the quadrupole magnetic field component 7 gives each beam a lens action which is divergent in a horizontal direction and convergent in a vertical direction as described by arrows in FIG. 2(*b*). Consequently, the sectional shape of the one electron beam 9 becomes horizontally long and vertically flat.

Due to this horizontally diverging lens action of the horizontal magnetic field, the just-focused situation of the beam spot on the screen is maintained in the horizontal direction during the deflection, since the diverging lens action compensates for the over-focusing of the beam caused by the increase in the electron beam path as the deflection angle is increased. On the other hand, however, for the vertical direction, the over-focusing of the beam becomes excessively large since the above-mentioned converging lens action of the horizontal magnetic field is added to the over-focusing action caused by the increase in the beam path at deflection. Accordingly, although the beam spot at the center of the phosphor screen is round as shown in FIG. 3(*a*), the beam spot in the peripheral part in the horizontal direction becomes distorted to a non-circular shape comprising a high luminance core portion 10 and a low luminance haze portion 11. The spot distortion, particularly the vertical haze 11, deteriorates the focus characteristic and resolution capability of the in-line type cathode ray tube.

With a conventional dynamic focusing method, if applied to the above-mentioned in-line type color cathode ray tube, the haze portion 11 in a vertical direction can be removed. However, for the horizontal direction in which the beam spot is already just focused, the beam becomes under-focused and the spot size in the horizontal direction increases since the dynamic focusing method weakens the action of the main lens both in the horizontal and vertical directions. As a result, the beam spot becomes excessively large in the horizontal direction and the resolution is severely deteriorated.

OBJECT AND SUMMARY OF THE INVENTION

The present invention intends to offer an improved cathode ray tube apparatus which can give a high resolution over the entire phosphor screen.

The cathode ray tube apparatus of the present invention comprises:

an in-line type color cathode ray tube having at least an accelerating grid, a first focusing grid and a second focusing grid in that order between a control grid and an anode, the first focusing grid having vertically oblong electron beam through-holes formed on its end face opposing the second focusing grid, the second focusing grid having a horizontally oblong electron beam through-hole formed on its end face opposing the first focusing electron grid, and a voltage supply means for supplying a static first focus voltage to the first focusing grid, a static high voltage to the anode and a dynamic voltage to the second focusing grid which varies to be higher than the static first focus voltage in response to an increase of a deflection angle of an electron beam.

BRIEF DESCRIPTION OF THE DRAWINGS

FIG. 2(*b*) is the cross-sectional diagram showing the relation between the other component of the horizontal deflection magnetic field and the electron beam.

FIG. 3(*b*) is the front view showing the shape of the beam spot produced at the peripheral part of the phosphor screen.

DESCRIPTION OF THE PREFERRED EMBODIMENTS

Figure 4:
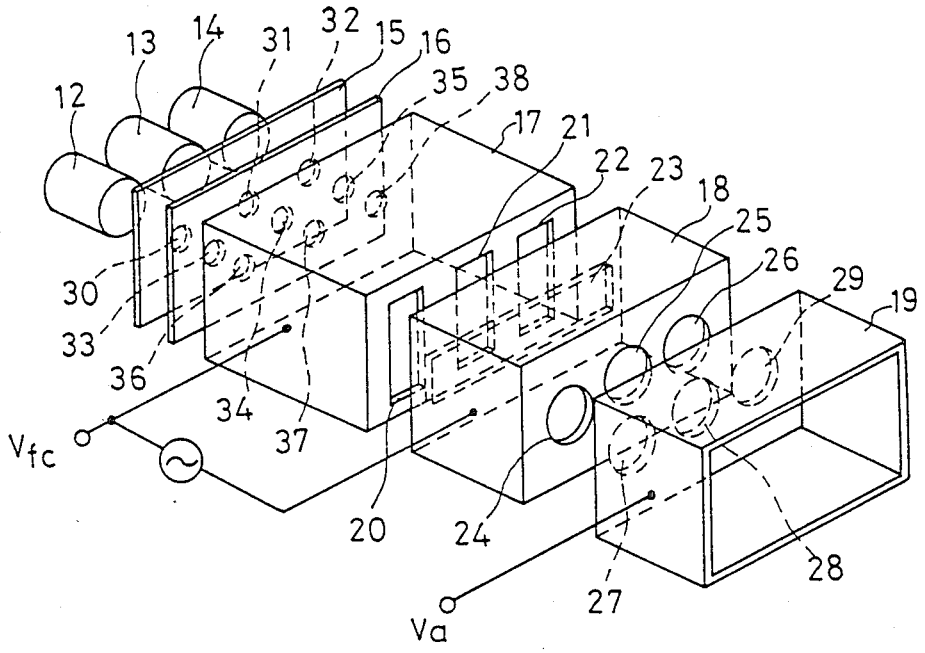
FIG. 4 is a perspective view of an embodiment showing an electron gun of a cathode ray tube apparatus of the present invention.

The electron gun of the in-line type color cathode ray tube apparatus of the present invention comprises three cathodes 12, 13, and 14 disposed on one horizontal plane, a control grid 15, an accelerating grid 16, a first focusing grid 17, a second focusing grid 18 and an anode 19 as shown in FIG. 4. The first focusing grid 17 is of a box type and has three electron beam through-holes 20, 21 and 22 which are oblong in a vertical direction and made on its end face opposing the second focusing grid 18. The second focusing grid 18 also is of a box type and has an electron beam through-hole 23 which is oblong in a horizontal direction and made on its end face opposing the first focusing grid 17. Second focusing grid 18 also has three electron beam through-holes 24, 25 and 26 which are circular and made on its end face opposing the anode 19. The anode 19 has three electron beam through-holes 27, 28 and 29 which are circular and made on its end face opposing the second focusing grid 18. The three main lenses are disposed between the second focusing grid 18 and the anode 19.

The control grid 15 has three circular electron beam through-holes 30, 31 and 32. The accelerating grid 16 has three circular electron beam through-holes 33, 34 and 35. The first focusing grid 17 has three circular electron beam through-holes 36, 37 and 38 which are made on its surface opposing the accelerating grid 16.

Figure 5:
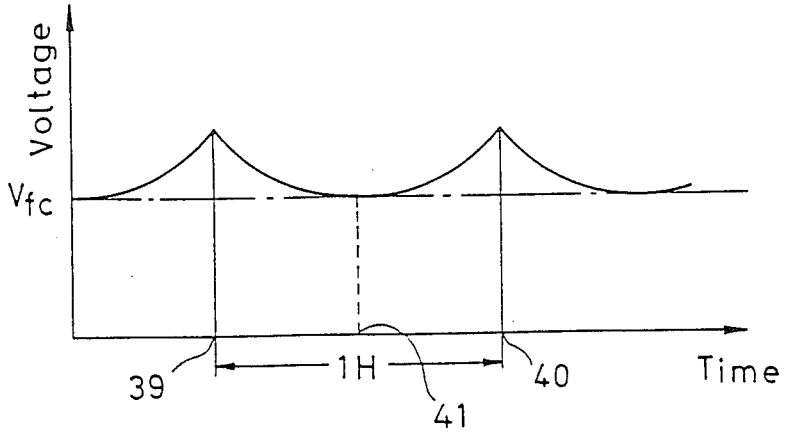
FIG. 5 is a waveform diagram showing a dynamic voltage supplied to a second focusing grid of the cathode ray tube apparatus of the present invention.

The typical direct current potential which is supplied to respective grids during operation are 50–150 V to the cathodes 12, 13 and 14; 0 V to the control grid 15; 300–500 V to the accelerating grid 16; 6 KV ($V_{fc}$) to the first focusing grid 17; and 25 KV (Va) to the anode 19. A dynamic voltage as shown in FIG. 5 which varies synchronously with a horizontal deflection frequency of the electron beam is supplied to the second focusing grid 18. A distance between a timing point 39 and a timing point 40, at which points the voltage waveform shows its peak value, corresponds to one horizontal period 1H. The horizontal deflection becomes zero at a middle timing point 41, at which point the voltage of the second focusing grid 18 becomes the potential $V_{fc}$ of the first focusing grid 17.

At the point in time that the horizontal deflection becomes zero, that is, the first and second focusing grids 17 and 18 become $V_{fc}$, even though the electron beam through-holes 20, 21, 22 and 23 of both grids are oblong in a horizontal direction or in a vertical direction, such shape of the holes does not influence the electron beam. A potential difference $Va-V_{fc}$ is produced between the second focusing grid 18 and the anode 19, and therefore, three main lenses are produced and the three electron beams are focused just at the center part of the phosphor screen.

At a time after the point of time 41, the horizontal deflection angle increases and the potential of the second focusing grid 18 becomes higher than the potential $V_{fc}$ of the first focusing grid 17. Therefore, a four pole lens electric field is produced between the grids 17 and 18 by the vertically long electron beam through-holes 20, 21 and 22 and the horizontally long electron beam through-holes 23. Also, the potential difference between the second focusing grid 18 and the anode 19 decreases and therefore the focusing operation of the main lens becomes weak.

Figure 1:
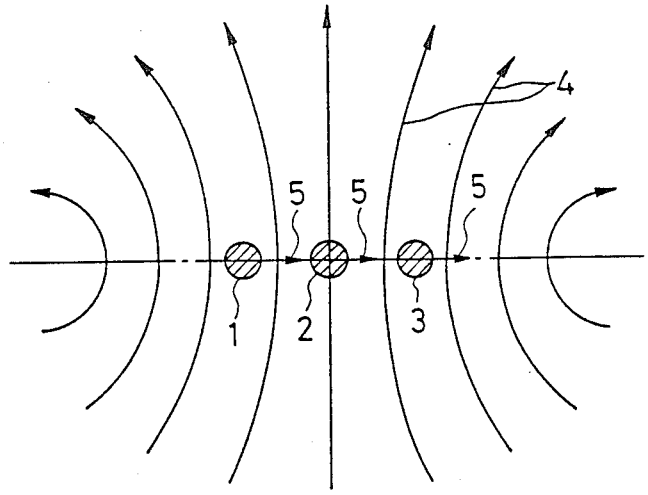
FIG. 1 is the cross-sectional diagram showing the relationship between the horizontal deflection magnetic field of a pincushion distribution and the electron beam.
Figure 2:
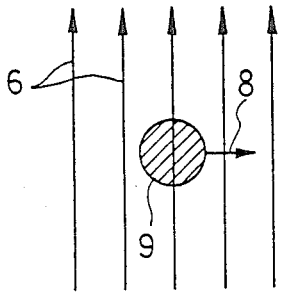
FIG. 2(*a*) is the cross-sectional diagram showing the relation between one component of the horizontal deflection magnetic field and the electron beam.
Figure 2:
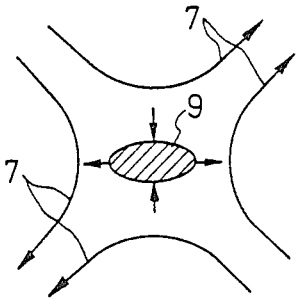
Figure 3:
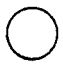
FIG. 3(*a*) is the front view showing the shape of the beam spot produced at the center part of the phosphor screen.
Figure 3:
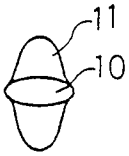
Figure 6:
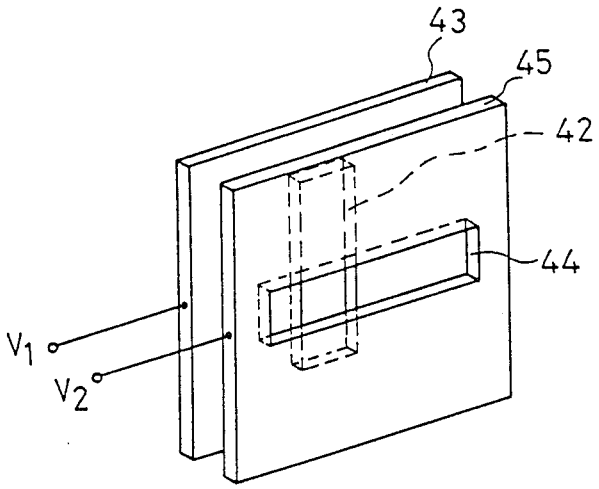
FIG. 6 is a perspective view showing a disposition of grids for forming a quadrupole lens electric field.
Figure 7:
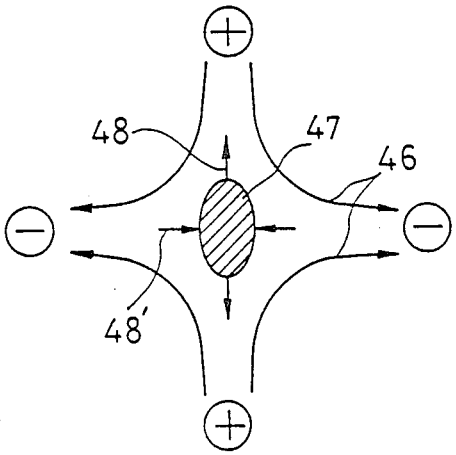
FIG. 7 is a cross-sectional diagram showing the relation between the quadrupole lens electric field and the electron beam.

FIG. 6 and FIG. 7 are drawings for describing the effect of the above-mentioned quadrupole lens electric field on the electron beam. For simplifying the description, in FIG. 6 a flat grid 43 having one vertically oblong electron beam through-hole 42 and a flat grid 45 having one horizontally oblong electron beam through-hole 44 are disposed facing each other. Potential $V_1$ is supplied to the flat grid 43 and the potential $V_2$ is supplied to the flat grid 45. Under such condition of $V_1$, $V_2$, the quadrupole lens electric field produced between the flat grids 43 and 45 is such that electric potentials at positions above and below the central position become positive, and electric potentials at positions left and right of the central position become negative with respect to the potential at the central position as shown in FIG. 7. Therefore, the line of electric force is produced in a direction shown by an arrow 46, and the electron beam 47 is enforced with attraction and repulsion force in directions shown by arrows 48 and 48'. Accordingly, the sectional shape of the electron beam 47 becomes vertically oblong. This vertically oblong sectional shape is just the opposite of the horizontally oblong sectional shape of the electron beam caused by the quadrupole component of the deflection magnetic field as shown in FIG. 2(*b*). Therefore, the horizontally oblong shape and the vertically oblong shape cancel each other, and thereby the horizontally oblong shape distortion of the electron beam can be prevented.

Further, the main lens operation becomes weak in response to the increase of the deflection angle as mentioned above, and therefore the over-focusing caused by the deflection of the electron beam can be overcome simultaneously. Accordingly, even at the peripheral parts of the phosphor screen, small diameter and nearly round beam spots can be obtained.

According to an experiment, the most adequate voltage which should be supplied to the second focusing grid 18 when the electron beam is deflected to the peripheral part at both side parts of the phosphor screen has been determined to be about 500 V on the basis of the direct current voltage on the first focusing grid 17. That is, the optimum maximum value of the dynamically varying voltage is about 500 V. Under such an optimum potential difference, the shape and dimension of the electron beam through-holes 20, 21, 22 and 23 and the position of these holes with respect to the main lens should be designed so that an optimum quadrupole lens electric field to be operated with the weakening action of the main lens is produced.

As mentioned above, in the in-line type color cathode ray tube, the beam spot is distorted more largely in the horizontal deflection than in the vertical deflection. Therefore, considerably improved beam spots can be obtained by supplying the dynamic voltage which is synchronous only with the horizontal deflection. However, to obtain a complete improvement, the dynamic voltage being synchronous also with the vertical deflection frequency can be superposed.

Figure 8A:
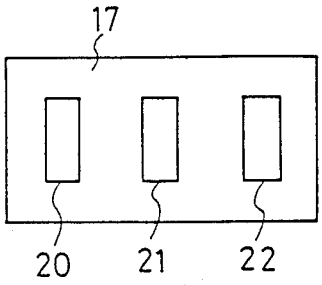
FIG. 8(*a*) and FIG. 8(*b*) are front views showing grids of another embodiment of the present invention.
Figure 8B:
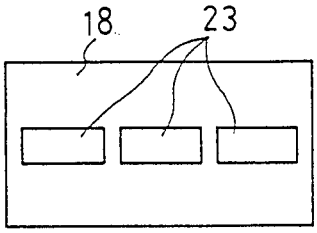
Figure 9A:
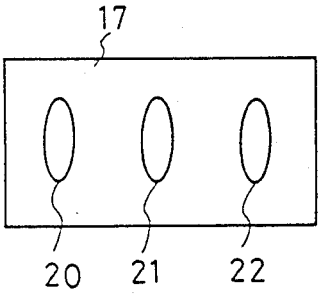
FIG. 9(*a*) and FIG. 9(*b*) are front views showing grids of still another embodiment of the present invention.
Figure 9B:
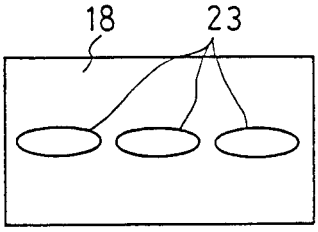
Figure 10A:
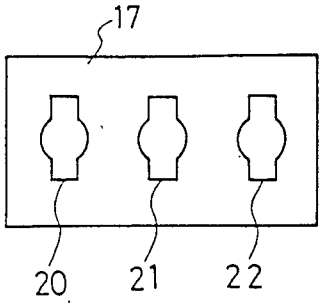
FIG. 10(*a*) and FIG. 10(*b*) are side views showing grids of still another embodiment of the present invention.
Figure 10B:
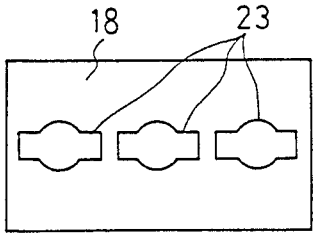

Further, in the above-mentioned embodiment, three vertically oblong electron beam through-holes 20, 21 and 22 are formed at the first focusing grid 17, and one horizontally oblong electron beam through-hole 23 is formed at the second focusing grid 18, but the shape of the hole is not restricted to the above-mentioned shapes. That is, the shape of the hole can be such as shown in FIGS. 8(*a*) and 8(*b*), FIGS. 9(*a*) and 9(*b*) or FIGS. 10(*a*) and 10(*b*), respectively.

What is claimed is:

1. A cathode ray tube apparatus comprising:

(1) an in-line type color cathode ray tube having at least one accelerating grid, a first focusing grid, a second focusing grid, a control grid and an anode, wherein (a) said accelerating grid and said first and second focusing grids are disposed in that order between said control grid and said anode, (b) said first focusing grid is box shaped and has three vertically oblong electron beam through-holes formed on an end face opposing said second focusing grid and three circular electron beam through-holes formed on another end face thereof opposing said accelerating grid, (c) said second focusing grid is box shaped and has a horizontally oblong electron beam through-aperture formed on an end face opposing said first focusing grid and three circular electron beam through-holes formed on another end face thereof opposing said anode for producing a main lens effect, and (2) voltage supply means for supplying:

(d) a static first focusing voltage to said first focusing grid, (e) a static high voltage to said anode, and (f) a dynamic variable voltage to said second focusing grid, which varies in a range higher than said first focusing voltage and responds to an increase in a deflection angle of an electron beam which starts from said first focusing voltage.

2. A cathode ray tube apparatus comprising:

(1) an in-line type color cathode ray tube having at least one accelerating grid, a first focusing grid, a second focusing grid, a control grid and an anode, wherein (a) said accelerating grid and said first and second focusing grids are disposed in that order between said control grid and said anode, (b) said first focusing grid is box shaped and has three vertically oblong electron beam through-holes formed on an end face opposing said second focusing grid and three circular electron beam through-holes formed on another end face thereof opposing said accelerating grid, (c) said second focusing grid is box shaped and has a horizontally oblong electron beam through-aperture formed on an end face opposing said first focusing grid and three circular electron beam through-holes formed on another end face thereof opposing said anode for producing a main lens effect, and (2) voltage supply means for supplying:

(d) a static first focusing voltage to said first focusing grid, (e) a static high voltage to said anode, and (f) a dynamic variable voltage to said second focusing grid, which varies in a range higher than said first focusing voltage and responds to an increase in a deflection angle of an electron beam which starts from said first focusing voltage in synchronism with a horizontal deflection frequency.

3. A cathode ray tube apparatus comprising:

(1) an in-line type color cathode ray tube having at least one accelerating grid, a first focusing grid, a second focusing grid, a control grid and an anode, wherein (a) said accelerating grid and said first and second focusing grids are disposed in that order between said control grid and said anode, (b) said first focusing grid is box shaped and has three vertically oblong electron beam through-holes formed on an end face opposing said second focusing grid and three circular electron beam through-holes formed on another end face thereof opposing said accelerating grid, (c) said second focusing grid is box shaped and has a horizontally oblong electron beam through-aperture formed on an end face opposing said first focusing grid and three circular electron beam through-holes formed on another end face thereof opposing said anode for producing a main lens effect, and (2) voltage supply means for supplying:

(d) a static first focusing voltage to said first focusing grid, (e) a static high voltage to said anode, and (f) a dynamic variable voltage to said second focusing grid, which varies in a range higher than said first focusing voltage and responds to an increase in a deflection angle of an electron beam which starts from said first focusing voltage in synchronism with a vertical deflection frequency.

* * * * *